US005622472A

United States Patent [19]

Glowacki

[11] Patent Number: 5,622,472

[45] Date of Patent: Apr. 22, 1997

[54] PROTECTIVE SHIELD FOR A TURBO-ENGINE

[75] Inventor: Pierre A. Glowacki, Ste Adresse, France

[73] Assignee: Societe Hispano-Suiza, Saint Cloud Cedex, France

[21] Appl. No.: 571,729

[22] Filed: Dec. 13, 1995

[30] Foreign Application Priority Data

Dec. 21, 1994 [FR] France ..... 94 15382

[51] Int. Cl.[6] ..... F01D 21/00

[52] U.S. Cl. ..... 415/9

[58] Field of Search ..... 415/9

[56] References Cited

U.S. PATENT DOCUMENTS 3,097,824 7/1963 Bunger et al. ..... 415/9

5,516,258 5/1996 Newton ..... 415/9

FOREIGN PATENT DOCUMENTS 0626502 11/1994 European Pat. Off. .

2375443 7/1978 France .

1466385 3/1977 United Kingdom .

*Primary Examiner*—John T. Kwon

*Attorney, Agent, or Firm*—Oblon, Spivak, McClelland, Maier & Neustadt, P.C.

[57] ABSTRACT

Protective shield (9) for a turbo-engine external fairing (3). It comprises a ring made of a ductile material retained by several fastening means relatively easy to break. When a rotor portion (17) accidentally detached strikes it, it dents it breaking some or all of its fasteners. By means of this possibility allowing for wide deformations of the shield (9), the capacity for absorbing energy is significant.

4 Claims, 3 Drawing Sheets

PROTECTIVE SHIELD FOR A TURBO-ENGINE

FIELD OF THE INVENTION

The purpose of the invention is to produce a shield for protecting a turbo-engine.

BACKGROUND OF THE INVENTION

This concerns a casing placed around a stator and more specifically in front of a bladed zone of a rotor surrounding the stator, that is in front of a compressor or turbine section in the machine, and is used to stop the blade or rotor pieces fragments which would be projected towards it under the action of centrifugal force following a rupture due to an accident.

The U.S. Pat. No. 4,452,563 describes a shield formed of a continuous network of fibrous strips draped on the outer face of the stator opposite the rotor. This design seems relatively ineffective as the fibers would tear quite easily and accordingly not provide sufficient protection. Honeycombed layers of material could also be placed on said outer surface of the rotor, but, despite the increase of energy absorption offered by such a structure to slow down or stop the projectiles, this absorption would be localized where the impact occurs and the shield would also in this instance be quite easily transpierced. The European patent 0 626 502 describes a shield formed of plates placed side by side but having the same drawbacks.

Finally, the French patent 2 375 443 describes a continuous ring shield which breaks its fasteners when a detached blade strikes it. But the shield can be used as a lining to the stator or replace it and it can only the absorb kinetic energy of the blade by taking on a rotating movement. It is unable to absorb the energy, as in the invention, on warping as there is not enough surrounding space to warp it; finally, it is only effective if the imparted energy is sufficient to break all the fasteners, which limits its possibilities in use.

SUMMARY OF THE INVENTION

The invention is based on the idea that it is preferable to have the entire shield participate in absorbing the impact by enabling it to warp and break its fasteners at the stator proportional to the energy received, this conception being original in that the ring is continuous and linked to the turbo-engine by fastening means calculated to break within a rupture limit of the shield subjected to an impact, and extends into an annular space between the stator and an outer fairing of the turbo-engine whilst being radially separated from the stator, as from the outer fairing.

As shall be seen, this characteristic makes it possible to more profitably transform the kinetic energy of the projectiles into mechanical deformation energy absorbed by the shield, which moreover is not normally punctured or transpierced and thus still isolates the outer parts of the turbo-engine from projectiles.

BRIEF DESCRIPTION OF THE DRAWINGS

There shall now follow a description of the invention accompanied by the following figures, given by way of non-restrictive example, illustrating the various characteristics of the invention.

DETAILED DESCRIPTION OF THE PREFERRED EMBODIMENTS

Figure 1:
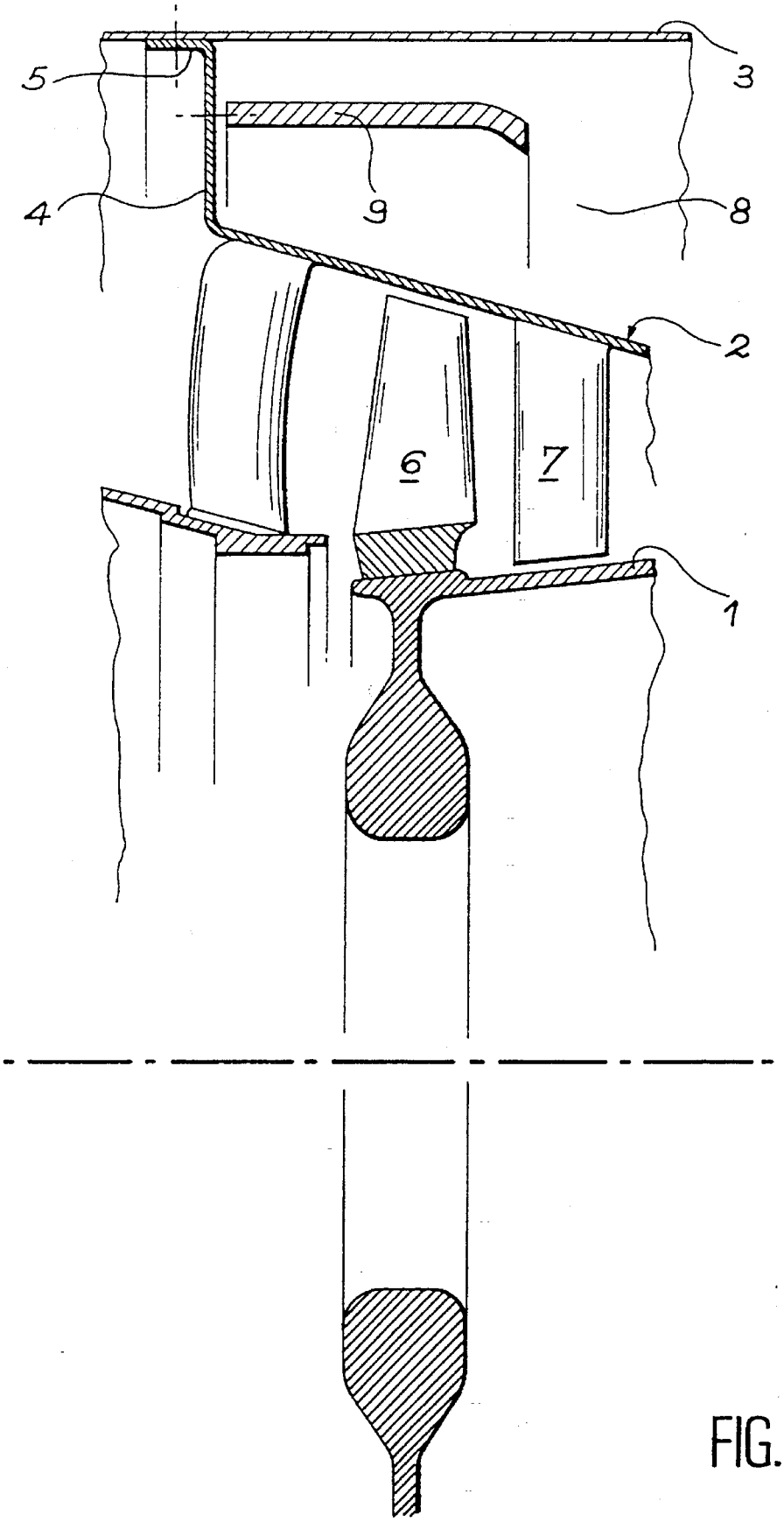
FIG. 1 is a general view of the position of the shield in the machine.

FIG. 1 shows a portion of the turbo-engine which comprises a rotor 1, a stator 2 in the form of a casing surrounding the rotor, and an outer fairing 3 surrounding the stator 2. The stator 2 has a circular flat flare which ends it upstream and which itself ends by a flange 5 adjusted on the internal face of the outer fairing 3 and riveted to it.

The rotor 1 and the stator 2 respectively bear alternate stages of mobile 6 and fixed 7 blades, this normally being the case to constitute the turbines and compressors.

A closed annular space 8 exists between the stator 2 and the outer fairing 3 downstream of the flare 4. The shield 9 occupies this space and extends to its central part: this means that it is radially separated from the outer fairing 3, as with the stator 2, without necessarily being at an equal distance from them. The shield 9 is a continuous ring made of a ductile, metallic or similar material, which has the advantage of absorbing a large amount of impact energy. It is supported by fasteners which join it to the flare 4. Many designs are possible and two shall be illustrated. On FIG. 2, the shield 9 has a bent back end into the shape of a flat circular flange in perforations in which screws 11 are engaged with longitudinal orientation and whose ends are retained in internal screw threads 12 bored in the flare 4. The screws 11 include a thinned portion 13 with a specific diameter and constituting a start of rupture at the limit junction point between the flare 4 and the flange 10.

Figure 3:
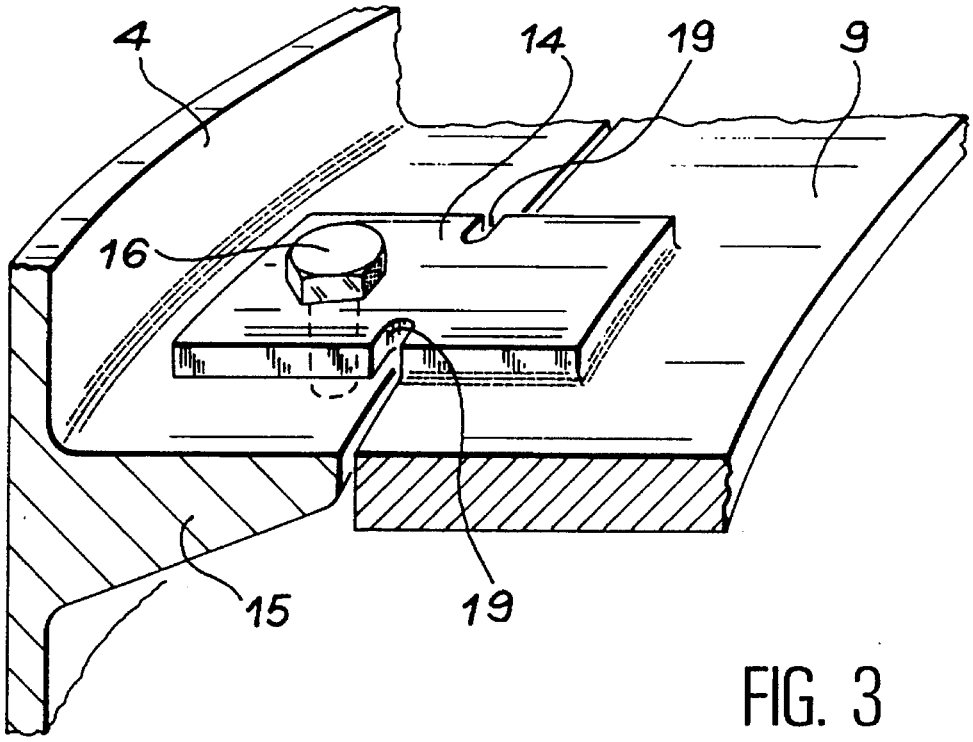

In the embodiment of FIG. 3, the flange 10 is replaced by brackets 14 in the prolongation of the shield 9, but are approximately thinner than the shield. The flare 4 is provided with a circular and continuous flange 15 extending the shield 9 and almost meeting it on which the brackets 14 rest. Screws 16, this time orientated in a radial direction, link the brackets 14 to the flange 15. A start of rupture is also provided in the form of notches 19 which shrink the brackets 14 at the limit of the shield 9 and flange 15.

Figure 2:
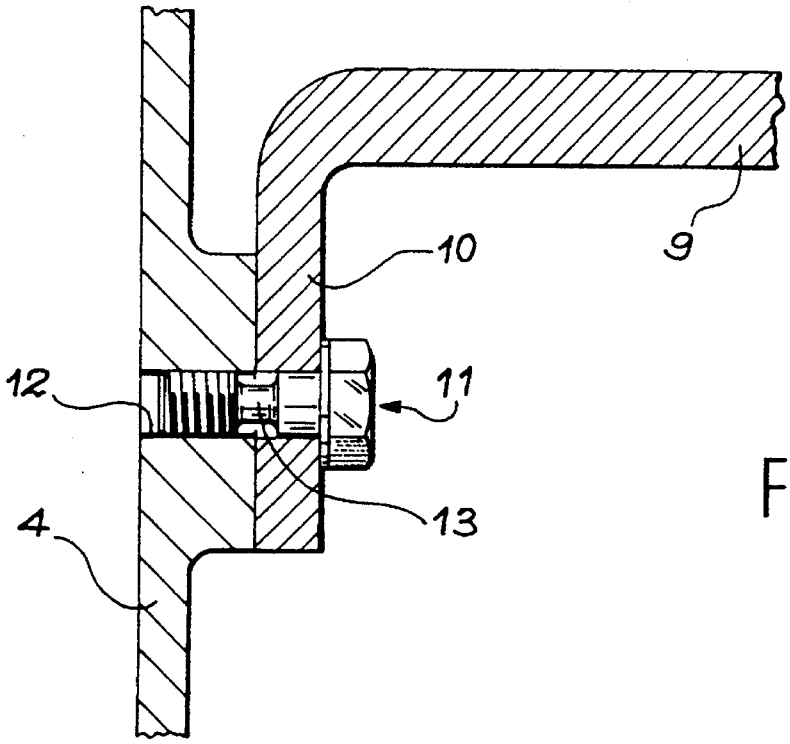
FIGS. 2 and 3 show two systems for fastening the shield.
Figure 4:
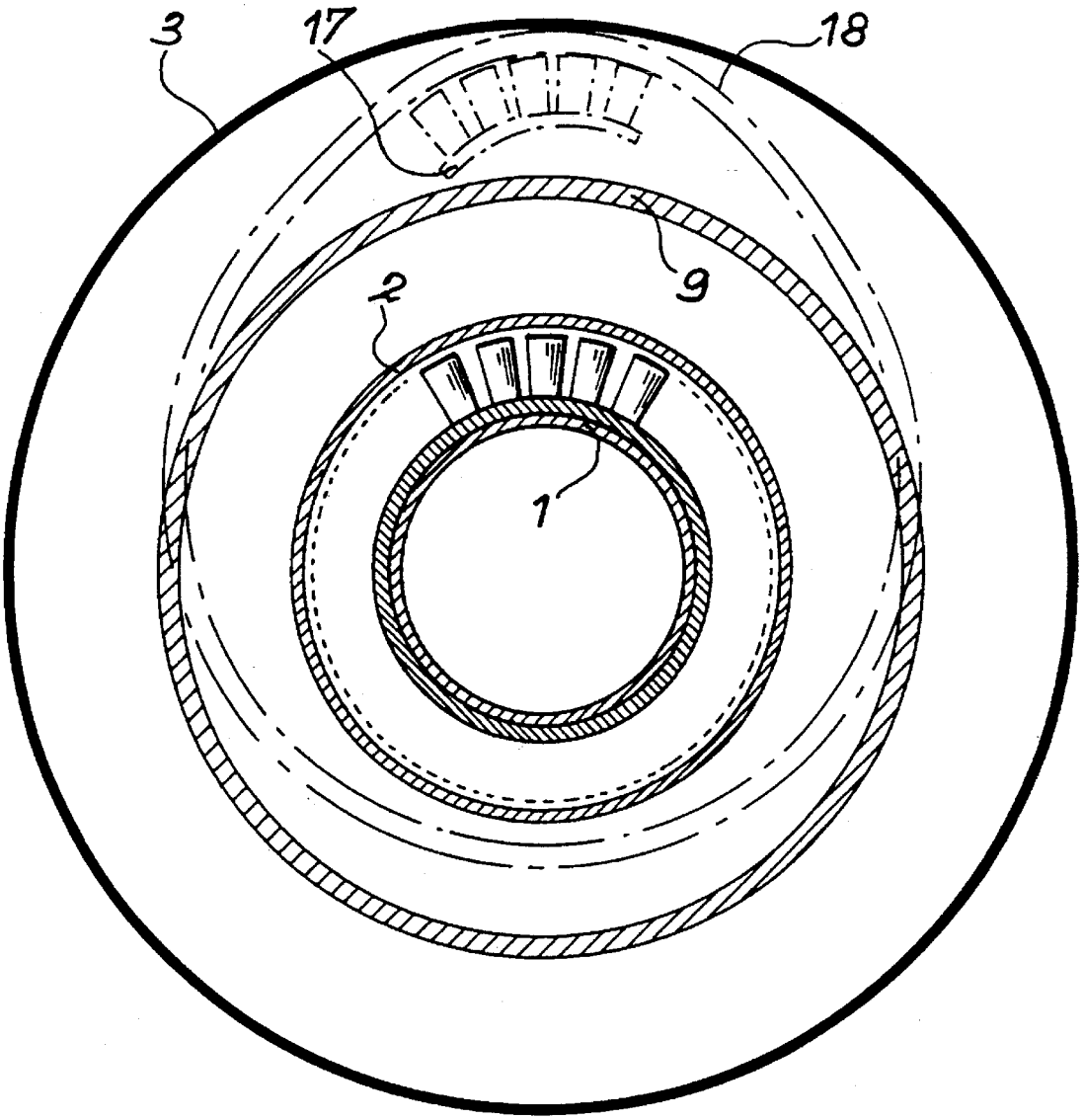
FIG. 4 shows the state of the shield alter an impact.

FIG. 4 shows what can happen after an impact caused by a rotor portion, such as a turbine disk fragment, which is accidentally detached during operation. The centrifugal force projects it outwardly at high speed. It bursts the stator 2 and then dents the shield 9. The plastic deformation, which is expressed by the appearance of the boss 18 on the portion of the shield 9 it strikes, results in a partial or total destruction of the fastening means if the kinetic energy of the rotor piece 17 so allows. In the embodiment of FIG. 2, the thinned portion 13 of the screws 12 is sheared; in that of FIG. 3, the brackets 14 are broken between the notches 19, here again by shearing. Generally speaking, it is also possible to use all known conceptions of rupture elements, as well as screws, bolts, studs, rivets or other means which are sectioned, torn or pulled up on traction, on compression or on shearing.

The broken fastening elements are firstly those close to the boss 18. If the impact is sufficiently violent, all the fastening elements may be affected and the shield 9 then becomes free, but as care has been taken to provide it with sufficiently high resistance to transpiercing, it does not open on impact and continues to protect the outer fairing 3 from direct contact with the rotor fragment 17, even if it strikes it or then rolls onto it. This resistance mainly depends on the thickness of the shield 9 and the resistance to rupture of the material which forms it.

The behavior and advantages of the invention can easily be understood. As the shield 9 does not rest directly on any surface, it can absorb the energy by warping freely over a large portion of its circumference or indeed over all of it. The stator 2 and the outer fairing 3 are spaced apart sufficiently to permit tiffs deformation. The total energy the system is able to capture is also increased by the rupture energy of the fastening means when at the same time this rupture authorizes a more extensive deformation of the shield 9 and thus increases its energy absorption capacity. Finally, if the shield 9 is fully detached, it is projected against the outer fairing 3, but FIG. 4 shows a particularly unfavorable situation as a single large fragment pulled up from the rotor 1 intervenes in the accident. In practice, it is often the case that several fragments with virtually the same weight are projected onto different portions of the shield 9 having a favorable result in that their kinetic energy is more fully absorbed (with their movement quantities balancing) and that the shield 9 is projected at a much slower speed which further reduces the risks of having the outer fairing 3 being damaged. Even if the kinetic energy of the projectiles is only partly transformed and only a significant portion is sent to the shield 9 when it is detached, one nevertheless ought to hope for a significant slowing down of the mobile mass and less damage to the outer fairing 3 by virtue of the regularity of the shape and rotundity of the shield 9.

What is claimed is:

1. A shield arrangement for protecting an outer fairing of a turbo-engine, the fairing surrounding the shield, the shield surrounding a stator envelope and the stator envelope surrounding a rotor driving blades, the shield being separated from the fairing and from the stator envelope, wherein the shield is deformable upon impact of one the blades being broken off the rotor, and the shield is connected to a part of the turbo-engine by fastening members having a breaking strength less than a tearing strength of the shield.

2. The arrangement shield according to claim 1, wherein the fastening means are screws, studs or traction or shearing slugs.

3. The arrangement shield according to claim 1, wherein the fastening means include brackets extending the shield.

4. The arrangement shield according to claim 1, wherein the fastening means include a less resistant portion fitted with starts of rupture.

* * * * *